US008288010B2

(12) United States Patent
Althöfer et al.

(10) Patent No.: US 8,288,010 B2
(45) Date of Patent: Oct. 16, 2012

(54) SHEET-METAL LAYER WITH ANTI-DIFFUSION STRUCTURES AND METALLIC HONEYCOMB BODY WITH AT LEAST ONE SUCH SHEET-METAL LAYER

(75) Inventors: Kait Althöfer, Wiehl (DE); Ludwig Wieres, Overath (DE); Michael Voit, Leverkusen (DE); Stefan Seeliger, Alterstedt (DE); Ferdi Kurth, Mechernich (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 13/279,433

(22) Filed: Oct. 24, 2011

(65) Prior Publication Data

US 2012/0064360 A1 Mar. 15, 2012

Related U.S. Application Data

(63) Continuation of application No. PCT/EP2010/055161, filed on Apr. 20, 2010.

(30) Foreign Application Priority Data

Apr. 24, 2009 (DE) ..... 10 2009 018 825

(51) Int. Cl.
*B32B 3/12* (2006.01)

(52) U.S. Cl. ..... 428/593; 428/603; 502/527.22; 502/439; 422/180; 228/181

(58) Field of Classification Search ..... None
See application file for complete search history.

(56) References Cited

U.S. PATENT DOCUMENTS 2,173,815 A * 9/1939 Slisz et al. ..... 428/158
3,190,412 A * 6/1965 Rutter et al. ..... 428/593
(Continued)

FOREIGN PATENT DOCUMENTS

DE 19539168 A1 4/1997
(Continued)

OTHER PUBLICATIONS

International Search Report of PCT/EP2010/055161, Dated Jul. 21, 2010.

*Primary Examiner* — John J Zimmerman
(74) *Attorney, Agent, or Firm* — Laurence A. Greenberg; Werner H. Stemer; Ralph E. Locher

(57) ABSTRACT

A sheet-metal layer includes anti-diffusion structures made of a high-temperature-corrosion-resistant steel having a longitudinal direction, upper and lower surfaces, a thickness of 0.015 to 0.1 mm and discontinuous microstructures extending approximately in the longitudinal direction. The microstructures have a structure height (0.02 to 0.1 mm), a structure length (2 to 10 mm), a structure width (0.2 to 1 mm), a longitudinal spacing (greater than 2 mm), formed by interruptions, from the nearest microstructure aligned approximately in the longitudinal direction and a lateral distance (1 to 10 mm) from the nearest laterally adjacent microstructure. Some of the microstructures project out of the sheet-metal layer toward the upper surface and some toward the lower surface. The microstructures cause each straight theoretical line extending across the sheet-metal layer perpendicularly to the longitudinal direction to intersect at least two microstructures projecting toward the upper surface and two microstructures projecting toward the lower surface.

23 Claims, 2 Drawing Sheets

U.S. PATENT DOCUMENTS

| | | | | |
|---|---|---|---|---|
| 3,958,714 | A * | 5/1976 | Barriere et al. | 220/592.2 |
| 4,152,302 | A * | 5/1979 | Nonnenmann et al. | 502/338 |
| 4,190,559 | A * | 2/1980 | Retallick | 502/300 |
| 4,805,180 | A * | 2/1989 | Maitland et al. | 372/61 |
| 4,987,034 | A * | 1/1991 | Hitachi et al. | 428/593 |
| 5,118,477 | A * | 6/1992 | Takikawa et al. | 422/179 |
| 5,157,010 | A | 10/1992 | Maus et al. | |
| 5,618,501 | A * | 4/1997 | Wieres et al. | 422/180 |
| 5,795,658 | A | 8/1998 | Bode et al. | |
| 6,040,064 | A * | 3/2000 | Bruck et al. | 428/593 |
| 6,841,135 | B2 | 1/2005 | Matsuoka | |
| 6,939,599 | B2 * | 9/2005 | Clark | 428/178 |
| 7,101,602 | B2 | 9/2006 | Althöfer et al. | |
| 2005/0044915 | A1 * | 3/2005 | Shimizu et al. | 72/186 |
| 2006/0162854 | A1 | 7/2006 | Althofer | |
| 2006/0168810 | A1 * | 8/2006 | Haesemann et al. | 29/890 |
| 2007/0040004 | A1 | 2/2007 | Althofer | |
| 2010/0196735 | A1 * | 8/2010 | Bruck et al. | 428/593 |

FOREIGN PATENT DOCUMENTS

| | | | |
|---|---|---|---|
| EP | 0 434 539 | A1 | 6/1991 |
| EP | 0454712 | A1 | 11/1991 |
| EP | 0784507 | B1 | 1/2000 |
| EP | 1156196 | A1 | 11/2001 |
| GB | 1216990 | A | 12/1970 |
| WO | 9735683 | A1 | 10/1997 |
| WO | 02090734 | A1 | 11/2002 |
| WO | 2005021198 | A1 | 3/2005 |
| WO | 2005107992 | A1 | 11/2005 |

* cited by examiner

SHEET-METAL LAYER WITH ANTI-DIFFUSION STRUCTURES AND METALLIC HONEYCOMB BODY WITH AT LEAST ONE SUCH SHEET-METAL LAYER

CROSS-REFERENCE TO RELATED APPLICATION

This is a continuation, under 35 U.S.C. §120, of copending International Application No. PCT/EP2010/055161, filed Apr. 20, 2010, which designated the United States; this application also claims the priority, under 35 U.S.C. §119, of German Patent Application DE 10 2009 018 825.8, filed Apr. 24, 2009; the prior applications are herewith incorporated by reference in their entirety.

BACKGROUND OF THE INVENTION

Field of the Invention

The present invention relates to the field of metallic honeycomb bodies of the kind which is used, in particular, in exhaust gas purification systems in motor vehicles and with internal combustion engines. Metallic honeycomb bodies are typically produced by winding or layering sheet-metal layers, with substantially smooth sheet-metal layers generally alternating with corrugated or similarly structured sheet-metal layers. In that way, channels that allow the passage of exhaust gas, with a size and shape matched to the respective application, are obtained. Typical honeycomb bodies for exhaust gas purification systems have between 50 and 1000 cpsi (cells per square inch), i.e. 50 to 1000 channels per square inch of cross-sectional area. As a particularly preferred option, such honeycomb bodies are provided with a coating which has catalytically active and/or adsorptive properties. In an exhaust system, honeycomb bodies for purifying exhaust gas are exposed to high alternating mechanical and thermal stresses, for which reason the metal sheets are brazed to one another, generally by high-temperature vacuum brazing. Modern metallic honeycomb bodies are not brazed together at all of the connection lines between the smooth and structured sheet-metal layers but are joined only at selected points according to specified brazing plans, depending on elasticity and stability requirements, and it is thereby possible to greatly increase their service life.

However, the temperatures employed in typical brazing processes are so high, e.g. above 1100° C., that diffusion bonds are formed between the contact points of sheets, even if there is no brazing material there and, as a result, the honeycomb body does not achieve the properties intended by a particular brazing plan but is too stiff and inflexible. Various methods have therefore been developed for enabling brazing material to be applied to very specific selected points and preventing diffusion bonds at points with no brazing material. Preventing diffusion bonds may require relatively expensive additional pre-oxidation processes or other additional processing steps to produce a passivation layer and/or may require that only certain materials be used.

The practice of providing smooth and/or corrugated sheet-metal layers in a metallic honeycomb body with microstructures is furthermore known from the prior art. One possible reason for doing so is to influence the flow in the honeycomb body since microstructures of a certain size lead to turbulence and better mixing of a gas flow than would be the case with laminar flow. Such microstructures are described, for example, in European Patent EP 0 784 507 B1, corresponding to U.S. Pat. Nos. 5,795,658 and 5,902,558.

International Publication No. WO 02/090734, corresponding to U.S. Pat. No. 7,101,602, has also disclosed structures which allow sheet-metal layers to slide more easily upon one another, something which may have advantages during the production process. That document has also already described advantages obtained from sharply defined brazed joints.

International Publication No. WO 97/35683 has also disclosed microstructures, in particular as stamped features on the corrugation peaks of corrugated metal sheets, which are intended in that case to enable a sufficient quantity of brazing material to be introduced at connection lines.

According to International Publication No. WO 2005/107992 A1, corresponding to U.S. Patent Application Publication No. US 2007/0040004 or International Publication No. WO 2005/021198 A1, corresponding to U.S. Patent Application Publication No. US 2006/0162854, for example, honeycomb bodies capable of withstanding high stresses can be printed with glue or binder at very specific points, allowing a precision in the specification and execution of even complex brazing plans which was unknown before those methods emerged. Despite those possibilities for the production of accurate, defined and small-area brazed joints between smooth and structured, in particular corrugated, sheet-metal layers, it was in many cases impossible to satisfactorily solve the problem of the additional diffusion bonds.

SUMMARY OF THE INVENTION

It is accordingly an object of the invention to provide a sheet-metal layer with anti-diffusion structures and a metallic honeycomb body produced by using at least one such sheet-metal layer, which overcome the hereinafore-mentioned disadvantages and at least partially solve the highlighted problems of the heretofore-known layers and bodies of this general type and, in particular, to specify a substantially smooth sheet-metal layer with microstructures, also referred to herein as anti-diffusion structures, which makes it possible to produce brazed joints between this sheet-metal layer and adjoining structured sheet-metal layers according to very specific brazing plans without the formation of additional extended diffusion joints, even if high brazing temperatures are employed.

With the foregoing and other objects in view there is provided, in accordance with the invention, a sheet-metal layer, comprising a high-temperature-corrosion-resistant steel, containing chrome and aluminum fractions in particular, having a longitudinal direction, an upper surface and a lower surface and a thickness of 0.015 to 0.1 mm, preferably 0.02 to 0.06 mm, wherein the sheet-metal layer includes discontinuous microstructures extending in the longitudinal direction or at an acute angle to the longitudinal direction.

The microstructures have a structure height, a structure length measured on the outside at half the structure height, and a structure width measured on the outside at half the structure height, and among each other a longitudinal spacing, measured at half the structure height, with respect to the nearest microstructure aligned approximately in the longitudinal direction thereof, with the spacing being formed by interruptions, and a lateral spacing, measured between the structure centers, with respect to the nearest laterally adjacent microstructure.

The microstructures are constructed in such a way that some of the microstructures project out of the sheet-metal layer toward the upper surface and some of the microstructures project out of the sheet-metal layer toward the lower surface.

The microstructures are furthermore spaced, disposed, and constructed in such a way that each straight theoretical line extending across the sheet-metal layer perpendicularly to the longitudinal direction intersects at least two microstructures projecting toward the upper surface and two microstructures projecting toward the lower surface.

Moreover, the following relations apply:

- the structure height is 0.02 to 0.1 mm, preferably 0.06 to 0.08 mm,
- the structure length is 2 to 10 mm, preferably 4 to 6 mm,
- the structure width is 0.2 to 1 mm, preferably approximately 0.5 mm,
- the longitudinal spacing with respect to the nearest microstructure aligned approximately in the longitudinal direction thereof is greater than 2 mm, preferably 4 to 8 mm, and
- the lateral spacing is 1 to 10 mm, preferably 2 to 6 mm.

A sheet-metal layer structured in this way is substantially smooth, despite the microstructures, and is also flexible enough for conventional production processes for metallic honeycomb bodies, due to the interruptions between the microstructures and because of the small structure height. During the alternate layering or winding of sheet-metal layers according to the invention including structured, in particular corrugated, metal sheets, the microstructures have the effect that only precisely defined contact points are formed between the corrugated and the smooth sheet-metal layers. It is then possible to choose from among these contact points those which are supposed to be connected to one another according to a predetermined brazing plan by applying brazing material and carrying out a brazing process. Due to the fact that the microstructures prevent contact between other points, unwanted linear diffusion bonds cannot occur, and it is therefore possible to produce honeycomb bodies with precisely defined properties with better reproducibility.

The combinations of dimensions indicated above are important for the effectiveness of the invention. Although there is a certain range of variation for each individual dimension, a certain minimum height of the microstructures is required to really exclude the possibility of contacts and ensuing diffusion bonds in the unstructured areas. On the other hand, the microstructures must not be too high since the stiffness of a sheet-metal layer increases with the height of the microstructures. The interruptions between the microstructures also promote flexibility.

During the layering or winding of sheet-metal layers according to the invention with adjacent corrugated sheet-metal layers, no corrugation peaks should rest directly in a linear manner on the upper surface or lower surface of the sheet-metal layer since that could lead precisely to unwanted extended diffusion bonds. The anti-diffusion structures must therefore be disposed in such a way that each adjacent corrugation rests on at least two microstructures in a defined manner. For this reason, some of the microstructures must be formed toward the upper surface and some of the microstructures must be formed toward the lower surface of the sheet-metal layer, and they must be so long in the longitudinal direction and be disposed offset relative to one another in different rows in such a way that this condition can be met. Although this condition can also, in principle, be imagined in the case of a chaotic configuration of microstructures, realistic production methods lead to a periodic configuration of the microstructures in adjacent rows, although there are relatively large degrees of freedom in the number of rows, the patterns in which microstructures are formed toward the upper surface and the lower surface, and with respect to the lengths and spacings of the microstructures. Typical embodiments are explained in greater detail with reference to the drawing.

In accordance with another, preferred embodiment of the invention, the microstructures are therefore disposed in rows approximately parallel to the longitudinal direction, and the longitudinal spacing between two microstructures in one row is 2 to 8 mm, preferably 4 to 6 mm.

In accordance with a further embodiment of the invention, the microstructures are preferably produced by stamping, especially in a single stamping step. Stamping is a relatively low-cost method, which can be integrated easily into known production processes for honeycomb bodies.

In accordance with an added embodiment of the invention, it is preferable if all of the microstructures at least in one row are formed toward the upper surface or top side, while all of the microstructures in at least one adjacent row project toward the lower surface or bottom side. It is most advantageous if a plurality of such rows of microstructures projecting toward the upper surface and the lower surface are formed on the smooth sheet-metal layer.

As an alternative, it is also possible for the microstructures in one row to project alternately toward the upper surface and the lower surface resulting, in particular, in a chessboard-like distribution of microstructures projecting toward the upper surface and the lower surface.

As already explained, interruptions between the microstructures are advantageous for the flexibility of a sheet-metal layer according to the invention although, in accordance with an additional embodiment of the invention, these interruptions make it necessary to place the microstructures belonging to different rows in a manner offset relative to one another in the longitudinal direction, preferably by an amount which is less than or equal to the structure length. In this way, it is possible to prevent the formation of areas in which there are no microstructures and where corrugation peaks of adjacent sheet-metal layers might come into contact over their entire length with the smooth sheet-metal layer.

With the objects of the invention in view, there is also provided a brazed honeycomb body, in particular for exhaust gas catalytic converters, comprising wound and/or layered alternating layers of substantially smooth and corrugated sheet-metal layers. At least one of the smooth sheet-metal layers is constructed with microstructures as described above according to the invention, and there are brazed joints between the corrugated and smooth sheet-metal layers substantially only at contact points between the corrugated sheet-metal layers and the microstructures.

All forms of honeycomb bodies which can be produced in accordance with the prior art, from smooth and structured sheet-metal layers, can also be produced in accordance with the known methods by using the sheet-metal layer described herein with anti-diffusion structures. Generally, the previously-known brazing methods can also be used, although it is particularly advantageous to employ high-precision selective brazing application methods, in particular those described in International Publication No. WO 2005/021198 A1, corresponding to U.S. Patent Application Publication No. US 2006/0162854, or International Publication No. WO 2005/107992 A1, corresponding to U.S. Patent Application Publication No. US 2007/0040004, for example. Due to the high precision already achieved in the prior art in the placement of brazing material, it is possible to apply brazing material at desired locations to the structures of a structured sheet-metal layer and/or to apply brazing material at the desired locations to the corrugation peaks of a smooth sheet-metal layer according to the invention with microstructures. In this way, according to a predetermined plan, contact points provided with glue are first of all formed, each on the order of less than 1 $mm^2$ in area, which can then be supplied with powdered brazing material and brazed in a conventional brazing process. In contradistinction to the prior art, the sheet-metal layer according to the invention does not give rise to any unwanted extended diffusion bonds at points in the honeycomb body where there is no brazing material. In this way, the already existing brazing plans or those worked out in the future for very specific stress patterns and properties can be implemented with high precision and without troublesome additional diffusion bonds, thereby also making possible the quality and life of metallic honeycomb bodies for applications involving extreme stresses. Although diffusion bonds can arise at contact points without brazing material, this can, on one hand, be reduced to a small number by using suitable patterns of microstructures. On the other hand, diffusion bonds covering a very small area are less critical for the properties of a honeycomb body because they break apart again under slight tensile or shear forces, which is not the case with relatively long linear bonds.

In accordance with a concomitant feature of the invention, appropriate glue application methods are preferably used to ensure that a multiplicity of adjacent pairs of brazed contact points at a spacing of less than 5 mm, preferably less than 3 mm, is formed, wherein the contact points belonging to a pair are situated along the same corrugation peak but on different microstructures. Brazing plans including two or even three adjacent joints increase the assurance that there will still be sufficiently good joints in the desired distribution, even if there are isolated inaccuracies in production.

Despite the anti-diffusion structures, the small structure height of the structures means that no gaps occur in the honeycomb body between the smooth and the corrugated metal sheets, which would interfere with subsequent coating with a washcoat and/or catalytically active material.

Other features which are considered as characteristic for the invention are set forth in the appended claims.

Although the invention is illustrated and described herein as embodied in a sheet-metal layer with anti-diffusion structures and a metallic honeycomb body with at least one such sheet-metal layer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
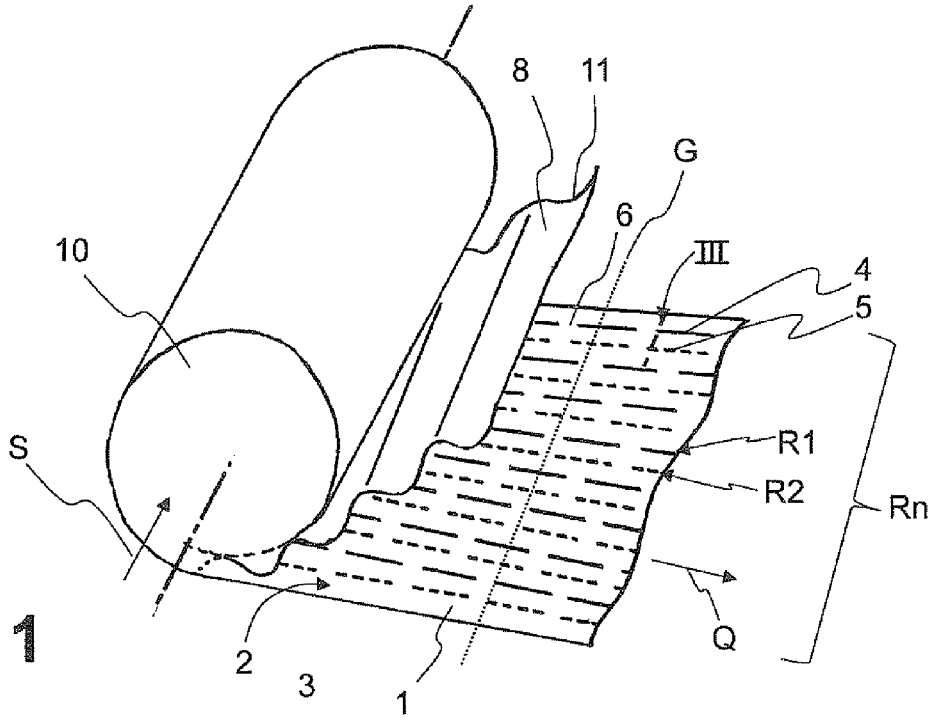
FIG. 1 is a fragmentary, diagrammatic, perspective view of a honeycomb body during production thereof, in which the body has a sheet-metal layer according to the invention with anti-diffusion structures.

Referring now in detail to the figures of the drawing for explaining the invention and the technical field in more detail by showing particularly preferred structural variants to which the invention is not restricted, and first, particularly, to FIG. 1 thereof, there is seen a diagrammatic illustration of a honeycomb body 10 which has not yet been fully wound and includes at least one substantially smooth sheet-metal layer 1 according to the invention, having a body with an upper surface or top side 2 and a lower surface or bottom side 3, which extends in a longitudinal direction Q. The longitudinal direction Q is transverse to a subsequent direction of flow S through the honeycomb body 10. The sheet-metal layer 1 is provided with microstructures 4 which project toward the upper surface and with microstructures 5 which project toward the lower surface. As will be seen in more detail in the following figures, the microstructures 4, 5 have a structure height SH, a structure length SL measured on the outside at half the structure height SH, and a structure width SB measured on the outside at half the structure height SH, and are spaced apart at a longitudinal spacing LA, measured on the outside at half the structure height SH, in the longitudinal direction Q, with the spacing being formed by interruptions 6. There is a lateral spacing SA between the microstructures 4, 5, which is measured between the structure centers, with respect to the nearest adjacent row of microstructures. The microstructures 4 in a first row R1 are all formed toward the upper surface 2 of the sheet-metal layer 1, while the microstructures 5 in a second row R2 are all formed toward the lower surface 3 of the sheet-metal layer 1. This configuration of the rows is repeated periodically with microstructures 4, 5 oriented alternately toward the upper surface 2 and the lower surface 3. At the same time, the microstructures 4, 5 in at least the rows which are oriented toward the same side are offset relative to one another in the longitudinal direction Q, more specifically in such a way that any straight theoretical line G, of which only one is indicated herein, extending across the sheet-metal layer 1 transversely to the longitudinal direction Q, intersects at least two microstructures 4, 5 projecting toward the upper surface and two microstructures projecting toward the lower surface. The line G is not perpendicular to the longitudinal direction Q and forms an angle therewith which is different than 90°. This has the effect that corrugation peaks 11 of adjacent corrugated sheet-metal layers 8 cannot subsequently come to lie between the microstructures 4, 5. The structure length SL can advantageously be chosen to be greater than the spacing between two corrugation peaks of an adjacent corrugated sheet-metal layer 8, thereby making it possible to ensure that almost any desired brazing plans can be implemented.

Figure 2:
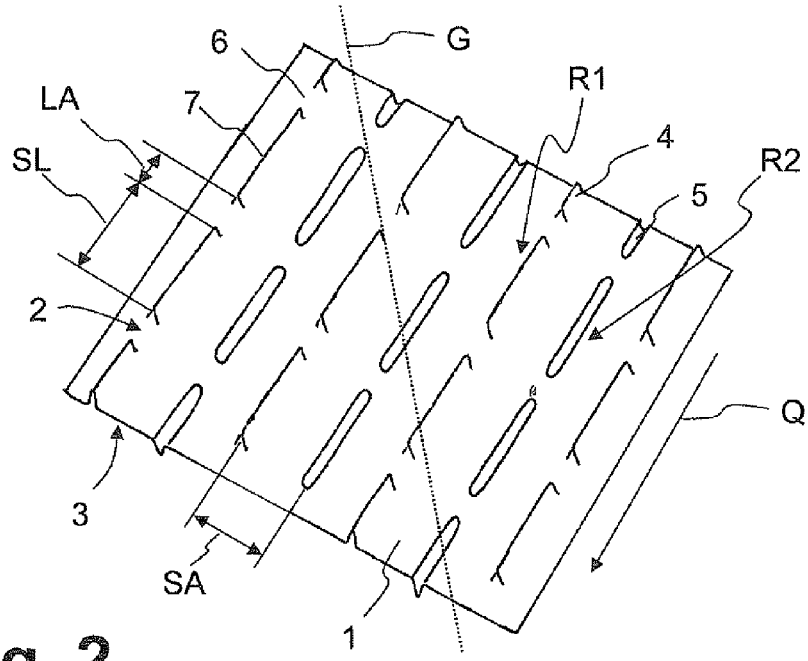
FIG. 2 is an enlarged, perspective view of the sheet-metal layer of FIG. 1.

FIG. 2 illustrates a configuration of the anti-diffusion structures in a substantially smooth sheet-metal layer 1 according to the invention. The microstructures 4 formed toward the upper surface 2 alternate with microstructures 5 formed toward the lower surface 3, with the microstructures 4, 5 being disposed in rows R1, R2, . . . , Rn). Rows containing microstructures 4, 5 projecting to one side are offset relative to one another in the longitudinal direction, preferably by an amount which is less than the structure length SL of the microstructures.

Figure 3:
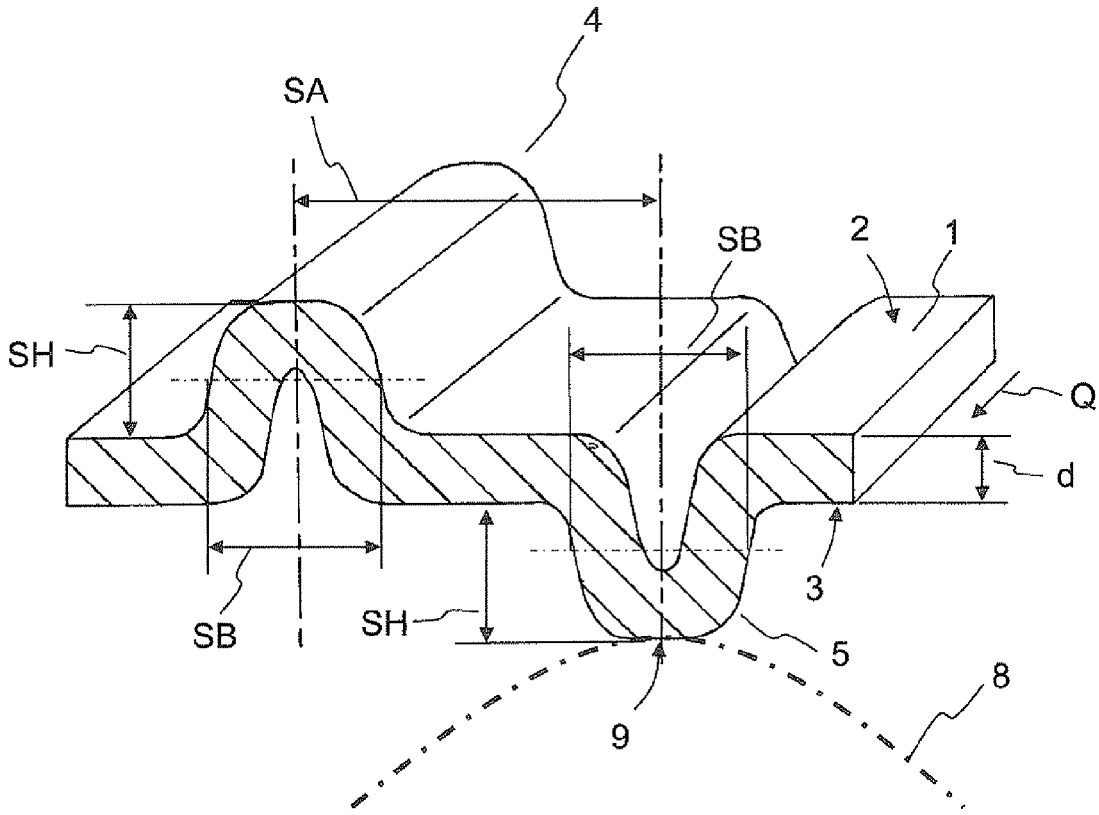
FIG. 3 is a further enlarged, cross-sectional view of a microstructure, which is taken along a line III of FIG. 1, in the direction of the arrows.

FIG. 3 shows the dimensions and approximate proportions of the microstructures 4, 5 on an enlarged scale. Since it is not possible to assume an ideal parallelepipedal form of the microstructures 4, 5, especially in the case of stamped features, the dimensions are based on suitable reference points. The structure height SH indicates how high a microstructure 4, 5 rises above the surface of the sheet-metal layer 1. The structure width SB is appropriately defined on the outside at half the height of the microstructures 4, 5, as are the structure length SL and the longitudinal spacing LA with respect to the nearest aligned microstructure 4, 5. The lateral spacing SA with respect to the nearest adjacent microstructure 4, 5 can more easily be defined between the centers of the microstructures 4, 5.

During the application of glue and brazing material to a honeycomb body according to the invention, as described in International Publication No. WO 2005/021198 A1, corresponding to U.S. Patent Application Publication No. US 2006/0162854, for example, an adhesive agent in the form of droplets of adhesive agent can be applied to a corrugated sheet-metal layer 8. The adhesive agent is applied in regions which are directly adjacent corrugation peaks 11. If, namely, a honeycomb body is built up from corrugated sheet-metal layers 8 and substantially smooth sheet-metal layers 1, a relative motion between the layers 1, 8 occurs during winding or coiling of the layers 1, 8. This leads to sliding of the corrugated sheet-metal layers 8 on the substantially smooth sheet-metal layers 1. If adhesive agent were applied directly to the corrugation peaks 11, this would increase the sliding friction between the layers 1, 8 and lead to smearing of the adhesive agent. However, the contact points between the corrugated sheet-metal layer 8 and the microstructures 4, 5 of a honeycomb body according to the invention must be connected to each other. Adhesive agent must therefore be applied in such a way that, after winding or layering of the honeycomb body, it is available in the vicinity of the contact points between the corrugation peaks of the corrugated sheet-metal layer 8 and the microstructures 4, 5. The applied adhesive zones should therefore be more extensive along the corrugation peaks 11 than the lateral spacing SA between two microstructures 4, 5 available for contact in order to ensure that in each case at least one contact point, preferably two adjacent contact points, can be reliably coated with brazing material and brazed. This is accomplished by applying powdered brazing material and subsequent brazing. Upon contact between the corrugated sheet-metal layer 8 and the microstructures 4, 5, stable wedge-shaped brazing areas are formed around the contact points 9. However, other glue and brazing material application methods can likewise be employed with similar results.

The present invention allows precisely reproducible production of metallic honeycomb bodies from corrugated and substantially smooth metal sheets involving even complex brazing plans, without troublesome additional linear diffusion bonds being formed. As a result, it is possible to match honeycomb bodies precisely to specific applications, and this increases their service life.

The invention claimed is:

1. A substantially smooth sheet-metal layer for a metallic honeycomb structure having at least one corrugated sheet-metal layer, the substantially smooth sheet-metal layer comprising:

a) a high-temperature-corrosion-resistant steel body having a longitudinal direction, an upper surface, a lower surface, a thickness of 0.015 to 0.1 mm, and discontinuous microstructures having an outside and structure centers and extending in said longitudinal direction or at an acute angle relative to said longitudinal direction;

b) said microstructures having a structure height, a structure length measured on said outside at half of said structure height, a structure width measured on said outside at half of said structure height, a mutual spacing formed by interruptions and measured at half of said structure height relative to a nearest microstructure aligned approximately in said longitudinal direction, and a lateral spacing measured between said structure centers relative to a nearest laterally adjacent microstructure;

c) said microstructures being configured to cause some of said microstructures to project out of the sheet-metal layer with contact points toward said upper surface and some of said microstructures to project out of the sheet-metal layer with contact points toward said lower surface, permitting brazed joints to occur substantially only between said contact points and the at least one corrugated sheet-metal layer;

d) said microstructures being spaced, disposed and configured to cause each straight theoretical line extending across the sheet-metal layer perpendicularly to the longitudinal direction to intersect at least two of said microstructures projecting toward said upper surface and at least two of said microstructures projecting toward said lower surface; and e) the following relationships apply:

said structure height is 0.02 to 0.1 mm, said structure length is 2 to 10 mm, said structure width is 0.2 to 1 mm, said longitudinal spacing relative to said nearest microstructure aligned approximately in said longitudinal direction thereof is greater than 2 mm, and said lateral spacing relative to said nearest laterally adjacent microstructure is 1 to 10 mm.

2. The sheet-metal layer according to claim 1, wherein said high-temperature-corrosion-resistant steel contains chrome and aluminum fractions.

3. The sheet-metal layer according to claim 1, wherein said thickness of said high-temperature-corrosion-resistant steel is 0.02 to 0.06 mm.

4. The sheet-metal layer according to claim 1, wherein:

said structure height is 0.06 to 0.08 mm, said structure length is 4 to 6 mm, said structure width is approximately 0.5 mm, said longitudinal spacing relative to said nearest microstructure aligned approximately in said longitudinal direction thereof is 4 to 8 mm, and said lateral spacing relative to said nearest laterally adjacent microstructure is 2 to 6 mm.

5. The sheet-metal layer according to claim 1, wherein said microstructures are disposed in rows approximately parallel to said longitudinal direction, and said longitudinal spacing between two of said microstructures in one of said rows is 2 to 8 mm.

6. The sheet-metal layer according to claim 5, wherein said longitudinal spacing between two of said microstructures in one of said rows is 4 to 6 mm.

7. The sheet-metal layer according to claim 1, wherein said microstructures are stamped.

8. The sheet-metal layer according to claim 1, wherein said microstructures are stamped in a single stamping step.

9. The sheet-metal layer according to claim 5, wherein all of said microstructures in at least one of said rows project toward said upper surface and all of said microstructures in at least one adjacent row project toward said lower surface.

10. The sheet-metal layer according to claim 5, wherein said microstructures disposed in different rows are offset relative to one another in said longitudinal direction.

11. The sheet-metal layer according to claim 10, wherein said offset is less than or equal to said structure length.

12. A brazed honeycomb body, comprising:

at least one of wound or layered, alternating, substantially smooth and corrugated sheet-metal layers;

at least one of said smooth sheet-metal layers including:

a) a high-temperature-corrosion-resistant steel body having a longitudinal direction, an upper surface, a lower surface, a thickness of 0.015 to 0.1 mm, and discontinuous microstructures having an outside and structure centers and extending in said longitudinal direction or at an acute angle relative to said longitudinal direction;

b) said microstructures having a structure height, a structure length measured on said outside at half of said structure height, a structure width measured on said outside at half of said structure height, a mutual spacing formed by interruptions and measured at half of said structure height relative to a nearest microstructure aligned approximately in said longitudinal direction, and a lateral spacing measured between said structure centers relative to a nearest laterally adjacent microstructure;

c) said microstructures being configured to cause some of said microstructures to project out of the sheet-metal layer with contact points toward said upper surface and some of said microstructures to project out of the sheet-metal layer with contact points toward said lower surface, permitting brazed joints to occur substantially only between said contact points and the at least one corrugated sheet-metal layer;

d) said microstructures being spaced, disposed and configured to cause each straight theoretical line extending across the sheet-metal layer perpendicularly to the longitudinal direction to intersect at least two of said microstructures projecting toward said upper surface and at least two of said microstructures projecting toward said lower surface; and e) the following relationships apply:

said structure height is 0.02 to 0.1 mm, said structure length is 2 to 10 mm, said structure width is 0.2 to 1 mm, said longitudinal spacing relative to said nearest microstructure aligned approximately in said longitudinal direction thereof is greater than 2 mm, and said lateral spacing relative to said nearest laterally adjacent microstructure is 1 to 10 mm;

said corrugated sheet-metal layers and said microstructures defining contact points therebetween; and brazed joints disposed between said corrugated and smooth sheet-metal layers substantially only at said contact points.

13. The brazed honeycomb body according to claim 12, wherein the brazed honeycomb body is configured for exhaust gas purification systems in motor vehicles.

14. The brazed honeycomb body according to claim 12, wherein:

said corrugated sheet-metal layers have corrugation peaks;

said contact points include a multiplicity of adjacent pairs of brazed contact points separated by a mutual spacing of less than 5 mm; and said contact points of a respective pair are situated along the same one of said corrugation peaks but on different microstructures.

15. The brazed honeycomb body according to claim 14, wherein said adjacent pairs of brazed contact points are separated by a mutual spacing of less than 3 mm.

16. The sheet-metal layer according to claim 1, wherein the at least one corrugated sheet-metal layer has corrugation peaks, and said microstructures are configured to ensure that none of the corrugation peaks of the at least one corrugated sheet-metal layer adjacent the substantially smooth sheet-metal layer rest directly in a linear manner on said upper or said lower surfaces.

17. The sheet-metal layer according to claim 1, wherein said microstructures are anti-diffusion structures configured on the substantially smooth sheet-metal layer to cause each corrugation, of the at least one corrugated sheet-metal layer adjacent the substantially smooth sheet-metal layer, to rest on at least two of said microstructures.

18. The sheet-metal layer according to claim 1, wherein said microstructures prevent a formation of areas without said microstructures on the substantially smooth sheet-metal layer, in which corrugation peaks of the at least one corrugated sheet-metal layer adjacent the substantially smooth sheet-metal layer, come into contact over their entire length with the substantially smooth sheet-metal layer.

19. The sheet-metal layer according to claim 1, wherein the at least one corrugated sheet-metal layer has corrugation peaks, and said microstructures directly contact the corrugation peaks at said contact points for brazed joints.

20. The brazed honeycomb body according to claim 12, wherein said corrugated sheet-metal layers have corrugation peaks, and said microstructures are configured to ensure that none of said corrugation peaks of said corrugated sheet-metal layers adjacent said substantially smooth sheet-metal layers rest directly in a linear manner on said upper or said lower surfaces.

21. The brazed honeycomb body according to claim 12, wherein said microstructures are anti-diffusion structures configured on said substantially smooth sheet-metal layers to cause each corrugation, of said corrugated sheet-metal layers adjacent said substantially smooth sheet-metal layers, to rest on at least two of said microstructures.

22. The brazed honeycomb body according to claim 12, wherein said corrugated sheet-metal layers have corrugation peaks, and said microstructures prevent a formation of areas without said microstructures on said substantially smooth sheet-metal layers, in which said corrugation peaks of said corrugated sheet-metal layers adjacent said substantially smooth sheet-metal layers, come into contact over their entire length with said substantially smooth sheet-metal layers.

23. The brazed honeycomb body according to claim 12, wherein said corrugated sheet-metal layers have corrugation peaks, and said microstructures directly contact said corrugation peaks at said contact points for brazed joints.

* * * * *